US007089951B2

(12) United States Patent
Bogart

(10) Patent No.: US 7,089,951 B2
(45) **Date of Patent: *Aug. 15, 2006**

(54) AIRPLANE HANGAR

(76) Inventor: Donald W. Bogart, 5786 Campo Walk, Long Beach, CA (US) 90803

( * ) Notice: Subject to any disclaimer, the term of this patent is extended or adjusted under 35 U.S.C. 154(b) by 0 days.

This patent is subject to a terminal disclaimer.

(21) Appl. No.: 10/789,170

(22) Filed: Feb. 27, 2004

(65) Prior Publication Data

US 2004/0163694 A1 Aug. 26, 2004

Related U.S. Application Data

(63) Continuation-in-part of application No. 09/891,426, filed on Jun. 27, 2001, now Pat. No. 6,758,230.

(51) Int. Cl.
*E04H 15/00* (2006.01)
*E04B 1/34* (2006.01)
*E04B 1/342* (2006.01)

(52) U.S. Cl. ..... 135/87; 135/123; 135/115; 135/907; 52/63; 52/222

(58) Field of Classification Search ..... 135/87, 135/123, 124, 115, 907, 908; 52/63, 222, 52/DIG. 14; 150/166
See application file for complete search history.

(56) References Cited

U.S. PATENT DOCUMENTS 1,350,289 A * 8/1920 Richards ..... 135/122
2,511,974 A * 6/1950 Finken et al. ..... 135/122
2,520,055 A * 8/1950 Pomerance ..... 135/120.2
2,556,617 A * 6/1951 Forrest ..... 135/124
3,116,746 A * 1/1964 Bird ..... 52/2.23
3,234,695 A * 2/1966 Johnson ..... 52/64
4,008,730 A * 2/1977 Keklak et al. ..... 135/90
4,259,819 A * 4/1981 Wemyss ..... 52/222
D274,157 S * 6/1984 Freeland ..... D25/56
4,557,284 A * 12/1985 Bray ..... 135/115
4,848,386 A * 7/1989 Cooper ..... 135/90
5,390,688 A * 2/1995 Lipman ..... 135/97
6,176,050 B1 * 1/2001 Gower ..... 52/222
6,273,114 B1 * 8/2001 Schaefer ..... 135/128
6,758,230 B1 * 7/2004 Bogart, Jr. ..... 135/87
2002/0043030 A1 * 4/2002 Bogart, Jr. ..... 52/64

* cited by examiner

*Primary Examiner*—Robert Canfield
(74) *Attorney, Agent, or Firm*—Marcia A. Devon

(57) ABSTRACT

A novel airplane shelter provides a plurality of arched vertical support members arranged axially along a line corresponding to the fuselage of an airplane to be sheltered. A cantilever beam is attached to the apex of each arched vertical support member, forming a "spine" along the top of the aligned arched support members. The cantilever beam is attached at one end to the rearwardmost arched support member, and the opposite end extends forwardly past the forwardmost arched support member to a point corresponding to the forwardmost point of an airplane to be sheltered. Separate lateral support members are placed at points corresponding to the wingtips of the airplane. The result is an open frame that defines a volume capable of enclosing an airplane. A covering material is placed over the open frame and stretched taut or otherwise secured over the entire structure.

10 Claims, 5 Drawing Sheets

AIRPLANE HANGAR

This Application is a Continuation-in-part of Ser. No. 09/891,426, filed Jun. 27, 2001, now U.S. Pat. No. 6,758, 230.

BACKGROUND AND SUMMARY OF THE INVENTION

A need has long existed for a reliable, convenient and relatively inexpensive hangar or shelter to protect airplanes and other winged aircraft, such as gliders, from the elements while parked on a flight line or otherwise out of use on the ground.

Currently, the two major existing solutions for sheltering airplanes are covers and structures. Covers, such as simple canvas or plastic tarpaulins, are relatively inexpensive, but suffer from several disadvantages. Covers, being stretched over the wings and body of the airplane, come into contact with exterior surfaces and objects, either causing damage directly or indirectly such as when dust is entrapped in the cover and wind causes the cover to flutter on the aircraft surface. This can cause scratching and other damage to polished and/or painted surfaces, as well as causing damage to external objects such as antennae, which can lead to unsafe operating conditions. Further, covers are often difficult for a single person to properly drape and secure over the airplane, which is very inconvenient for pilots flying solo. Additionally, covers tend to be form fitting over the airplane, making it difficult or even impossible to perform maintenance or safety checks or to enter the aircraft. Even further, a cover must be removed and properly stored each time the airplane is to be used, then replaced over the airplane when the airplane is returned to the flight line, adding to the time and effort required to otherwise enjoy flying. Pilots end up making several significant sacrifices in order to save on the initial investment in a cover.

While structures, such as traditional hangar buildings offer one-time setup, they also suffer from several disadvantages. Buildings are generally non-portable, while with some cover designs, the hangar can be moved to other locations. Structures require much more in the way of design, floor plans, materials and assembly labor than a cover, and are therefore much more expensive to produce. Further, they often require a building foundation, depending on the type of soil, and are not easily constructed except by professionals. Additionally, prior designs have complicated wing-spanning trusses or arches which are both expensive and difficult for the individual plane owner to assemble.

Due to the inconvenience of covers and the expense of structures, many airplane owners may opt to forego sheltering their airplanes, leaving them unprotected from the elements, leading to excessive deterioration of exterior surfaces and equipment. Undetected, the resulting corrosion could, in time, lead to catastrophic alteration of the airfoil surfaces, causing dangerous flying conditions. Exposure to the elements is also damaging to aircraft interiors, avionics and electronics.

What is needed is a low-cost structure that includes the advantages of a cover. Such a structure should be relatively easy to assemble without professional assistance, substantially cover an airplane to protect it from the elements, and still permit convenient access to the airplane for various purposes. Such a structure is provided in the instant invention.

Consequently, a novel airplane shelter is described herein which enhances a structure with the best features of a cover.

In order to achieve the advantages of this airplane shelter, a substantially rigid skeletal frame has been invented that, with the use of a unique cantilever structure, provides connections and support for cables and material to enclose and protect an airplane. A plurality of arched vertical support members are arranged axially along a line corresponding to the fuselage of an airplane to be sheltered. The line extends from essentially the trailing edge of the airplane's wings to a point at or just past the trailing edge of the airplane's tail assembly. A cantilever beam is attached to the apex of each arched vertical support member, forming a "spine" along the top of the aligned arched support members.

The cantilever beam is attached at one end to the rearwardmost arched support member, and the opposite end extends forwardly past the forwardmost arched support member to a point corresponding to the forwardmost point of an airplane to be sheltered. Separate lateral support members are placed at points corresponding to the wingtips of the airplane to be sheltered. The result is an open skeletal frame that defines a volume that is capable of enclosing an airplane.

A covering material is placed over the open skeletal frame and stretched taut, by attachment to the extreme elements of the skeletal frame, covering all of the arched vertical support members, the cantilever beam, and the open space between the forwardly-extending portion of the cantilever beam and the two lateral support members adjacent to each wingtip of the airplane to be sheltered. The covering material is attached to both of the lateral support members. Cables may be attached between the cantilever beam and the lateral support members to provide additional support for the covering material.

The resulting structure, in top plan view, resembles an arrow, where the shaft of the arrow houses the airplane fuselage, and the arrowhead houses the wings, cockpit, and nose of the airplane. The forwardmost end of the cantilever beam can be secured by a rope, chain, or rigid member or similar element attached to a point on the ground to prevent excessive motion and to keep the material taut in the direction between lateral support members across the cantilever beam. Additional covering material may optionally be used to provide door flaps and/or walls. The elements of the invention may optionally be provided in a kit for assembly by an airplane owner.

As will be seen in the following description and drawings, the claimed invention provides an airplane shelter which combines the low cost and easy assembly of a cover, while also providing the sturdy construction and ability to access the airplane found in structures. The use of a central cantilever beam and small lateral support members, instead of expensive vertical walls and horizontal ceiling structures, to support a covering material provides sufficient shelter to protect an airplane from the elements while still allowing sufficient access to the airplane for loading, unloading, maintenance, and other purposes.

DETAILED DESCRIPTION OF THE PREFERRED EMBODIMENT

While those skilled in the art will recognize that the present invention can easily be adapted for use with a wide variety of aircraft, the description herein assumes, but is not intended to be limited to, a single engine monoplane of size and dimensions similar to any of many makes and models presently in use.

Figure 1:
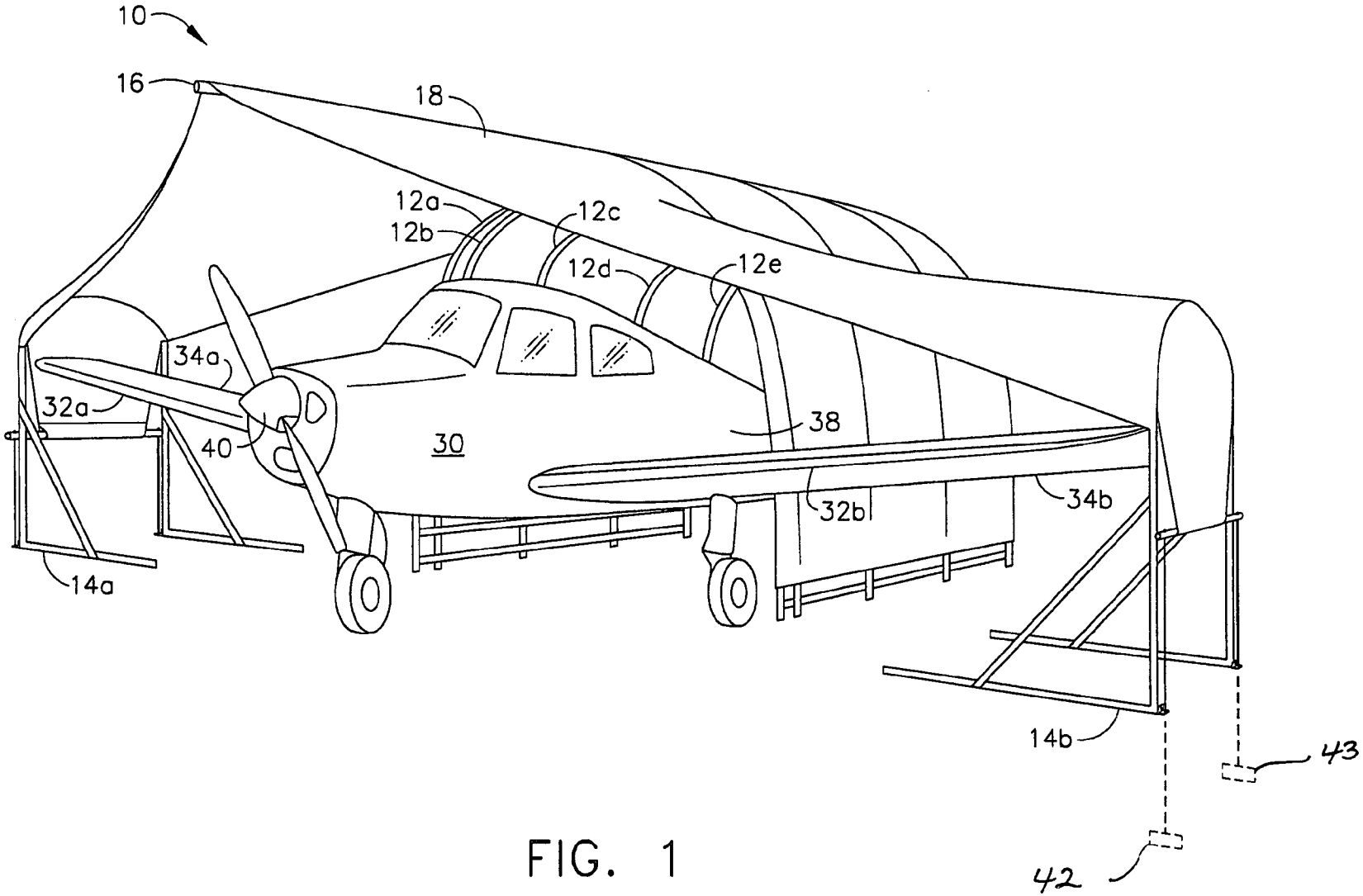
FIG. 1 is an isometric perspective view of the present invention sheltering a typical small airplane.

As can be seen in FIG. 1 and in subsequent figures, the present invention provides an airplane shelter 10 for sheltering of an airplane 30. The shelter 10 is comprised of a plurality of vertical support members 12*a–e*, a cantilever apex beam 16, a pair of lateral support members 14*a,b*, a removable pole 24 and a covering material 18. Optional elements include central support cables 20*a,b*, forward support cables 22*a,b*, front door flaps 26*a,b*, cantilever support cable 21 and support pole 23, supplemental cantilever beams 17*a, b*, and walls.

The vertical support members 12*a–e* may be essentially arched in configuration, but may be of any of a number of shapes which will rest on the ground on either side of the fuselage 38 of airplane 30 and extend over the top of fuselage 38 such that covering material 18 maybe supported over the top and along both sides of fuselage 38. For example, rectangular, triangular, or other symmetrical configurations will also work, as long as there is sufficient room for the tail assembly of airplane 30 to pass beneath each vertical support member 12*a–e*.

Each vertical support member 12*a–e* includes a respective apex 13*a–e*, and may be made of wood, metal, or other suitable material. Choice of material may depend on the size of the shelter to be constructed, prevailing weather conditions, expense constraints, the temporary or permanent nature of the intended use of the shelter, or other factors. Hollow steel tubing offers the advantages of strength, low expense, and light weight, though other materials, such as wood, aluminum, or plastics may be used.

The vertical support members 12*a–e* are placed in an aligned fashion along a line at least as long as the distance from the trailing edge 34*a,b* of the wings 32*a,b* of airplane 30 to the rearward most point of the tail assembly. The respective apexes 13*a–e* of vertical support members 12*a–e* are aligned along a line parallel and directly above the longitudinal centerline of the fuselage 38 of airplane 30, with the cross-section of each arch parallel to the others such that a "tunnel" is formed of a size able to accommodate the passing through of the tail assembly of airplane 30 and able to contain the entire fuselage 38 and tail assembly of airplane 30. The vertical support members 12*a–e* are spaced apart to provide sufficient support for the covering material 16 over the length of the "tunnel". The ends of vertical support members 12*a–e* may rest freely on the ground, but should be attached or weighted to prevent unintended movement of the airplane shelter 10 due to wind or minor collision of people or equipment. Those skilled in the art will recognize numerous ways to attach or weight the ends in a satisfactory manner designed to meet local conditions and individual needs.

A cantilever apex beam 16 is placed on the top of the vertical support members 12*a–e* and physically attached at each respective apex 13*a–e* by bolting, welding, tying, or other suitable method. One end of the cantilever apex beam is attached to the last vertical support member 12*e* in the rear, while the opposite end extends forwardly past the first vertical support member 12*a* in the front, along the line defined by the aligned respective apexes 13*a–e* to a point at least as far forward as the nose assembly 40 of airplane 30. The unsupported portion of cantilever apex beam 16 is therefore usually longer than the portion supported by vertical support members 12*a–e*, depending on the type of aircraft to be covered. While the cantilever apex beam 16 may be made of the same material as vertical support members 12*a–e*, it should be made of a material that is sufficiently stiff to resist excessive bending due to its own weight and the added weight of the portion of covering material 18 that it will support. The combination of the vertical support members 12*a–e* and the cantilever apex beam 16 forms an open skeletal frame for supporting covering material 18.

Figure 8:
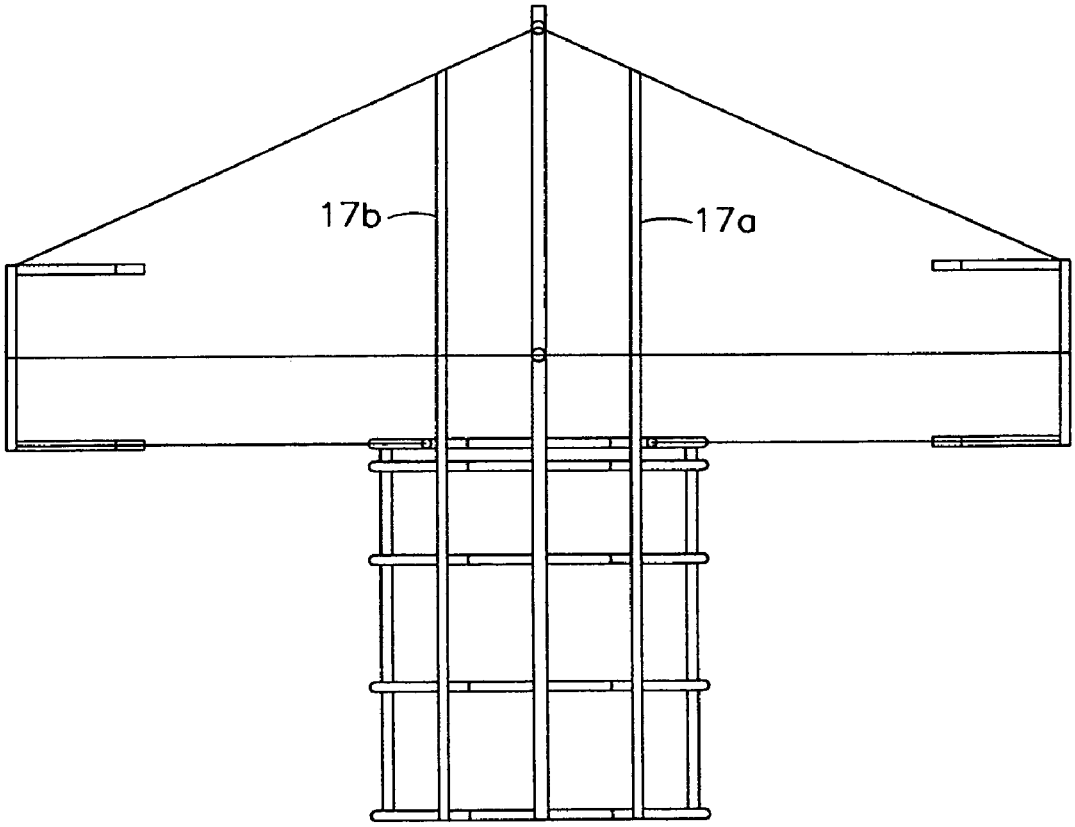
FIG. 8 is a view of the present invention as shown in FIG. 2 with the supplemental cantilever beams 17*a,b*.

As shown in FIG. 8, if additional support for covering material 18 is desired, supplemental cantilever beams 17*a,b* may be additionally attached to vertical support members 12*a–e*. In such a case, it may be desirable for vertical support members 12*a–e* to have a substantially flat top so that supplemental cantilever beams 17*a,b* are at the same height as cantilever apex beam 16.

Figure 10:
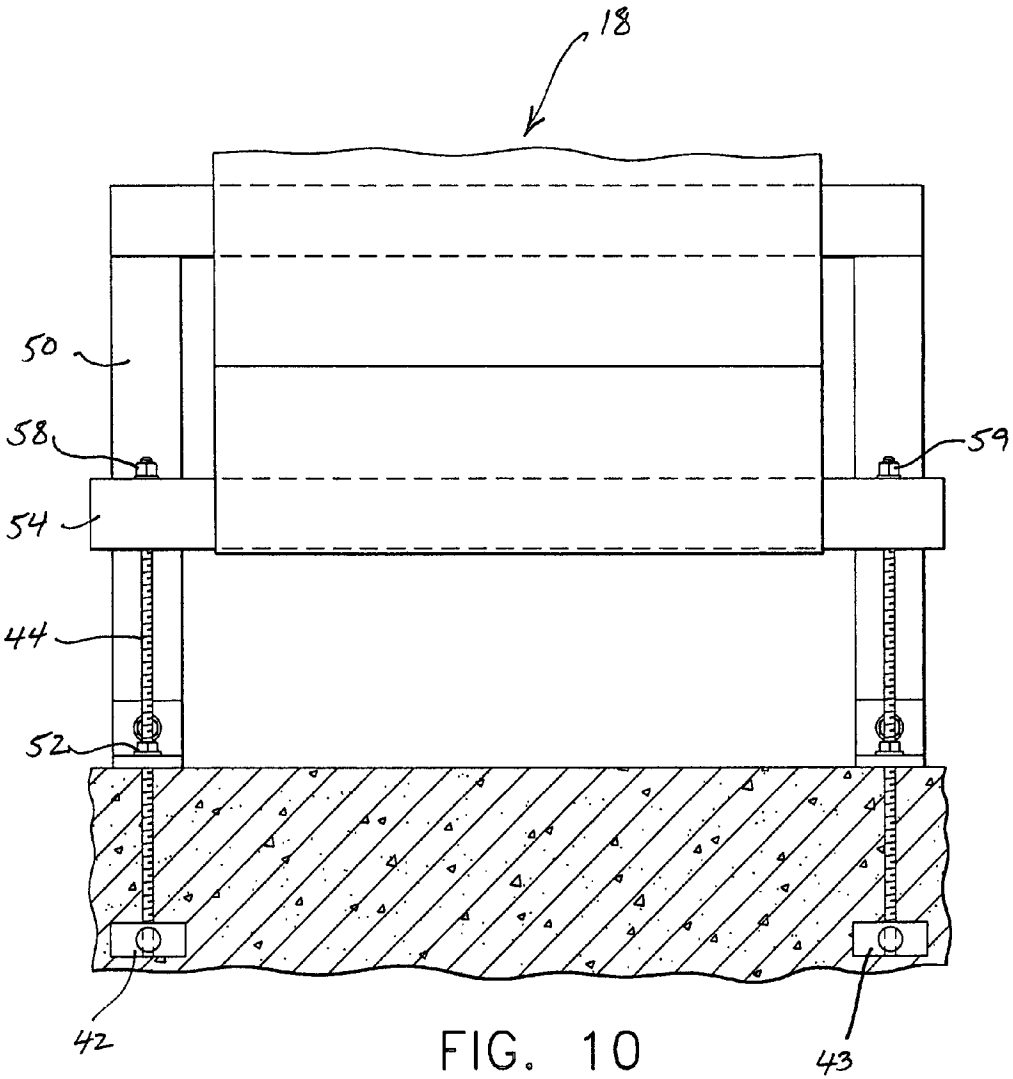
FIG. 10 is a view of FIG. 9 taken along the line 10—10.

Unattached to the rest of the open skeletal frame described above are two lateral support members 14*a,b*, each placed just beyond a point corresponding to the respective tips of wings 32*a,b* of airplane 30. The lateral support members may be posts, poles, frames or other object sufficiently sturdy and of sufficient height to support covering material 18 and keep it raised off of airplane 30 when properly attached. As with vertical support members 12*a–e*, lateral support members 14*a,b* are preferably positively attached or weighted to the ground to avoid undesired motion or movement, such that they provide a secure anchor for the hangar and the covering material 18 in order to maintain the tautness of covering material 18. It will be appreciated by those skilled in the art that the design lateral support members may vary. For example, upper portion of the lateral support member shown in FIG. 1 is arched and the covering pulled over the arch. However, in the preferred embodiment, the upper portion of lateral supports are rectangular as shown in FIG. 10 which functions more readily with the tightening mechanism hereinafter described.

Figure 6:
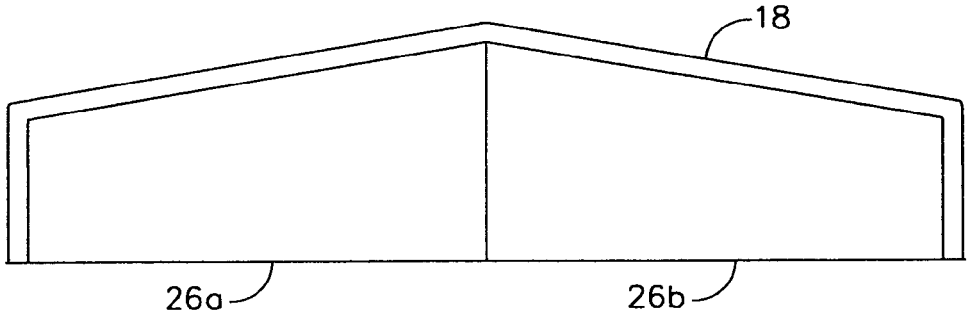
FIG. 6 is a front elevation view of the present invention including optional front door flaps. The door flaps are shown in the closed position.

A covering material 18 of cloth, canvas, plastic, metal sheeting or similar material, is placed over the open skeletal frame and stretched taut. It is then fastened by bolting, tying, adhesives, or other appropriate method, to sufficient locations along one or more vertical support members 12*a–e* and cantilever apex beam 16 to prevent undesired removal or flapping due to wind or other adverse conditions. Covering material 18 is also similarly sufficiently stretched taut over each lateral support member 14*a,b*. Covering material 18 may consist of a single sheet of material configured to fit the open skeletal frame, or may consist of multiple sheets placed over the open skeletal frame in sections. If multiple sheets are used, it may be desirable to seal the sheets together by stitching, zippers, tying, heat sealing/welding, or other appropriate method, in order to prevent the elements from entering between sheets. Covering material 18 may be configured to cover only the top of the structure, leaving sides open for easy access, or may be configured to cover substantially all of the exterior of the open skeletal frame, including backs and sides, in order to offer maximum protection. Access for the plane will be by the opening provided by the vertical area defined by the cantilever apex beam 16 and lateral support members 14*a,b*. Though normally open, the front of the airplane shelter 10 may be covered by extensions of covering material 18 to form door flaps 26*a,b*, as can be seen in FIG. 6.

Because of the nature of the open skeletal frame and the unique cantilever apex beam 16, airplane 30 can be easily moved in and out of the airplane shelter 10 formed by the combination of the open skeletal frame, connected cables, and covering material 18. There is no rigid non-moveable structure obstructing the movement of airplane 30, because the vertical support members define arched cross sections that are wider and higher than the tail assembly of airplane 30, and the lateral support members 14*a,b* define a distance wider that the span of wings 32*a,b* of airplane 30.

If additional support is desired for covering material 18 over the expanse between cantilever apex beam 16 and lateral support members 14*a,b*, cables may be strung between points on these elements of the structure. The covering material 18 may have a hem around its perimeter into which support cables can be inserted. In an alternative embodiment of the present invention, covering material 18 may be of a stiffer material such as wood, plastic or sheet metal.

Figure 2:
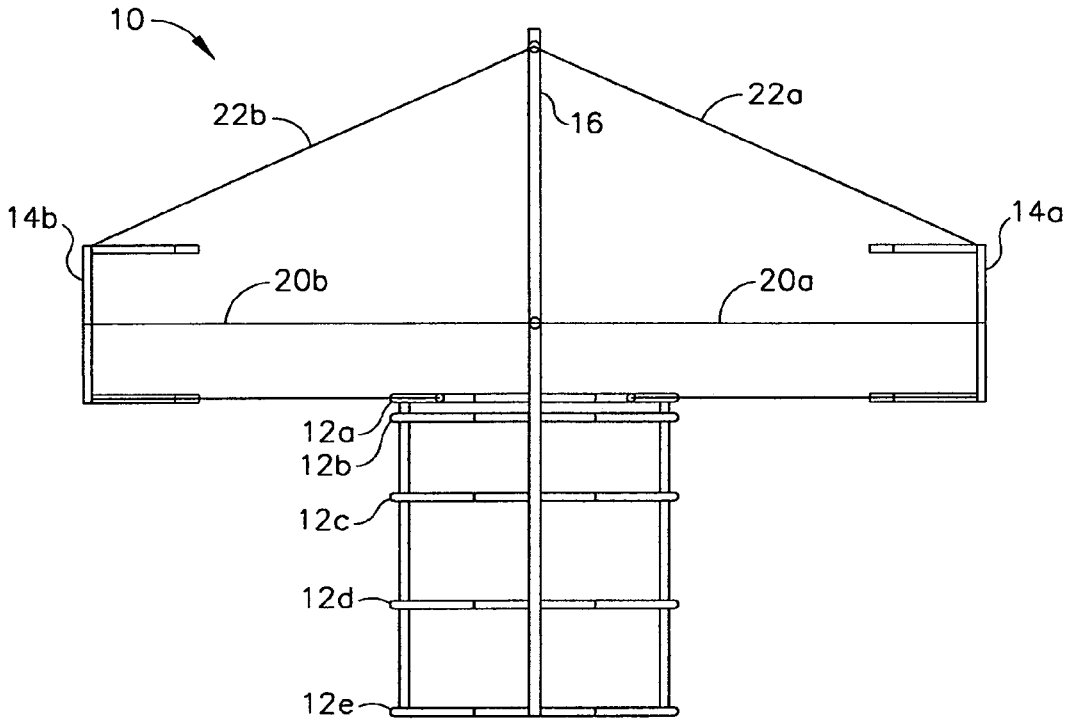
FIG. 2 is a top plan view of the open skeletal frame, without covering material, of the present invention.
Figure 3:
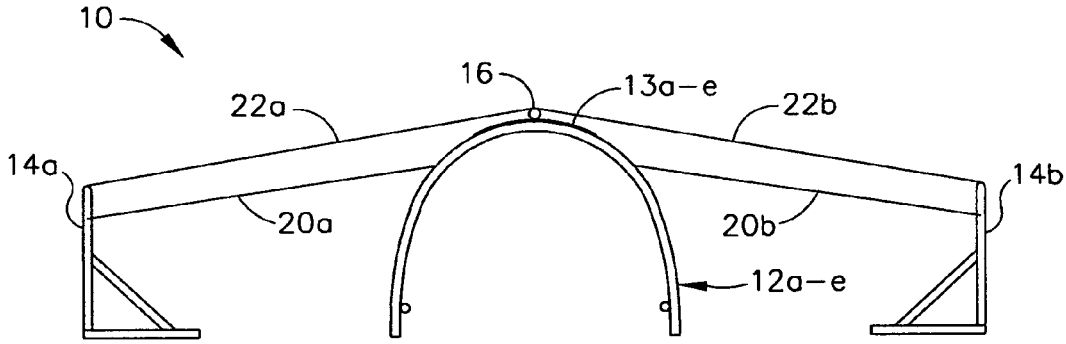
FIG. 3 is a front elevation view open skeletal frame depicted in FIG. 2.
Figure 4:
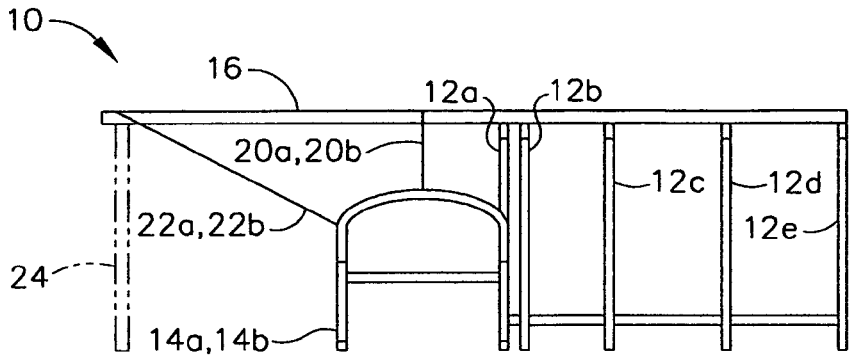
FIG. 4 is a side elevation view of the open skeletal frame depicted in FIG. 2. The removable support pole 24 is also shown.
Figure 7:
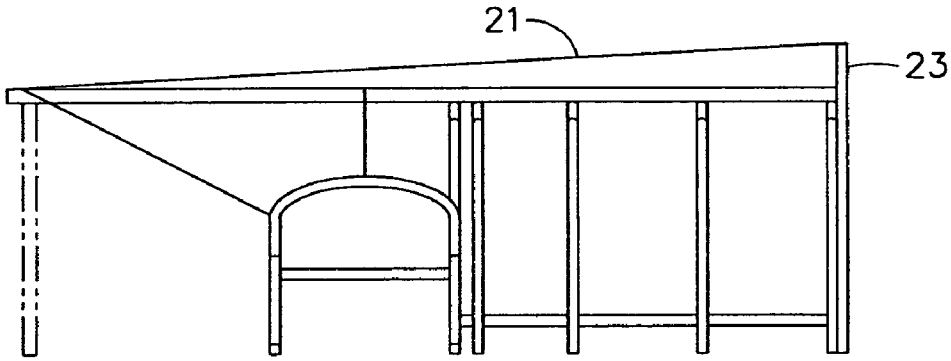
FIG. 7 is a view of the present invention as shown in FIG. 4 with the cantilever support cable 21 and cantilever support pole 23.

Supplemental cantilever beams 17*a,b* may also be attached to the plurality of vertical support members 12*a–e*. FIGS. 2, 3, and 4 depict central support cables 20*a,b* and forward support cables 22*a,b*. FIG. 8 depicts supplemental cantilever beams 17*a,b*. Further, it may be desirable to provide additional vertical support to the forward end of cantilever apex beam 16 by fastening a cantilever support cable 21, as shown in FIG. 7, between the forward end of cantilever apex beam 16 and a cantilever support pole 23. The vertical cantilever support pole 23 or similar rigid member is mounted at or near the rear end of airplane shelter 10 and rises vertically above the height of cantilever apex beam 16.

Figure 5:
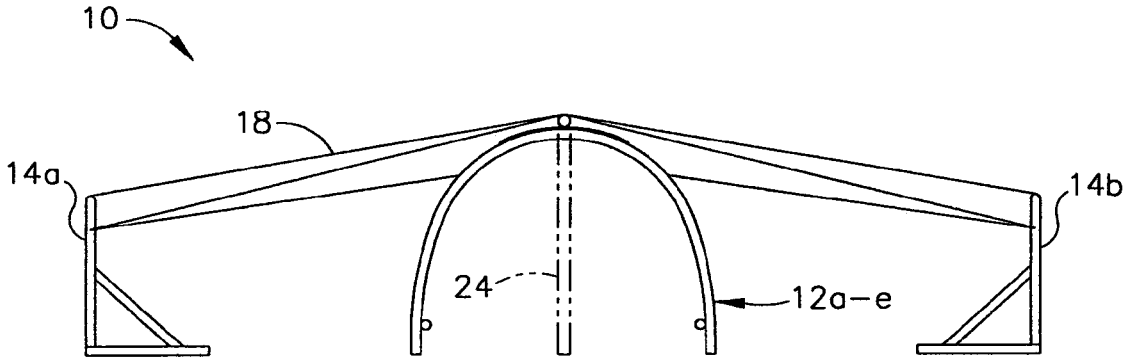
FIG. 5 is a front elevation view of the present invention showing both the covering material 18 and removable support pole 24.

As depicted in FIGS. 4 and 5, a removable support pole 24 may be used to provide restraint on the free movement of the free forward end of cantilever apex beam 16. Removable support pole 24 may be a rope, chain, cable or similar flexible material removably attached to the forward free end of cantilever apex beam 18 and to a point on the ground or other suitable anchor. If desired, support pole 24 may also be a wood, metal, or plastic pole or other relatively rigid member. If a rigid member is used, support pole 24 also provides additional vertical support for covering material 18, adding resistance to sustain additional loads due to collected snow and/or water in inclement weather conditions.

Figure 9:
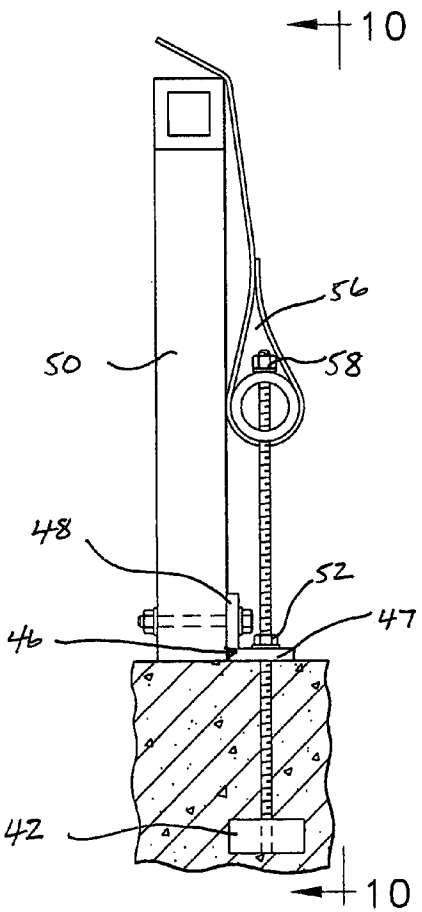
FIG. 9 is a side view of one of the lateral supports 14 showing means for anchoring the hangar.

The lateral support members 14 are preferably secured by utilizing ground anchors 42 and 43 that may be sunk in the ground or in cement as shown generally in FIG. 1. A more detailed structure for securing the lateral support members 14 and for controlling the tension of the covering 18 is shown in FIGS. 9 and 10. An all-thread rod 44 is preferably used to interconnect the ground anchors with the lateral supports. One end of the all-thread rod 44 is inserted into each ground anchor. Angle bracket 46 comprised of two perpendicular planes, a first plane 47 that is placed against the ground or cement and a second plane 48 placed against the upright, vertical portion 50 of the lateral supports 14. The rods are then inserted through an opening provided in angle bracket 46 and secured to the angle bracket with a nut 52. The second plane 48 of the angle bracket is affixed to the vertical portion 50 of the lateral support 14 in a conventional manner, e.g. with nut 53.

A pipe 54 is inserted into the hem 56 formed in the portion of the covering 18 which is placed over the lateral supports. Openings are drilled or otherwise provided in the pipe 54 to receive the upper end of the all-threads 44 which is then secured with nuts 58 and 59. Tightening the nuts 58 and 59 provide a method of making minute adjustments in the fabric tension. Thus, the fabric may be prevented from sagging and accumulating moisture from the elements as well as being prevented from being pulled too tightly such that there is excessive force on the cantilever beam 16.

It is anticipated that the elements of the present invention could be provided as a kit for assembly by a consumer, though such is not necessary to embody the inventive concepts of the present invention.

What is claimed is:

1. A shelter for an airplane having a fuselage, wings and a tail, said shelter comprising:

a plurality of vertical support members arranged parallel to each other and adapted to extend over the fuselage of an airplane between the tail of the airplane and the wings of the airplane;

a singular cantilever beam attached to the upper portion of each one of said plurality of vertical support members, forming an upright-standing shelter structure with said cantilever beam, adapted to extend forwardly over the nose of the airplane;

a pair of lateral support members adapted to be positioned proximate to each wingtip of said airplane;

covering material arranged over said shelter structure, including over the cantilever beam and laterally to each said pair of lateral support members such that said airplane is adapted fit entirely beneath said covering material;

support cables attached to said cantilever beam and to each of said lateral support members for supporting said covering material over the wings of said airplane and;

means for anchoring the shelter.

2. A shelter for storing an airplane having a fuselage, wingtip and a tail, said shelter comprising:

a plurality of vertical support members arranged parallel to each other and adapted to extend over the fuselage of an airplane between the tail of the airplane and the wings of the airplane;

a singular cantilever beam attached to the upper portion of each one of said plurality of vertical support members, forming an upright-standing shelter structure with said cantilever beam, adapted to extend forwardly over the nose of the airplane;

a pair of lateral support members adapted to be positioned proximate to each wingtip of said airplane;

covering material arranged over said shelter structure, including over the cantilever beam and laterally to each said pair of lateral support members such that said airplane is adapted to fit entirely beneath said covering material;

support cables attached to said cantilever beam and to each of said lateral support members for supporting said covering material over the wings of said airplane and;

an anchor for securing the shelter to a fixed location.

3. The shelter of claim 1 wherein said covering material includes a hem adapted to receive cables or rods.

4. The shelter of claim 1 further including means for adjusting the tension of said covering material.

5. A shelter situated on the ground for an airplane having a fuselage, wings and a tail, said shelter comprising:

a plurality of vertical support members arranged parallel to each other and adapted to extend over the fuselage of an airplane between the tail of the airplane and the wings of the airplane;

a cantilever beam attached to the upper portion of each one of said plurality of vertical support members, forming an upright-standing shelter structure with said cantilever beams adapted to extend forwardly over the nose of the airplane;

a pair of lateral support members adapted to be positioned proximate to each wingtip of said airplane;

covering material arranged over said shelter structure including over the cantilever beam and laterally to each said pair of lateral support members such that said airplane is adapted to fit entirely beneath said covering material;

support cables attached to said cantilever beam and to each of said lateral support members for supporting said covering material over the wings of said airplane;

a hem in the edge of said covering material placed over said lateral support members and means for adjusting the tension of said covering material wherein said means for adjusting includes:

at least one anchor associated with each lateral support member;

at least one rigid member associated with each lateral support member, each rigid member having a first and second end, said first end received by said anchor;

a rod inserted into said hem, said rod having a means for receiving said second end of said rigid member;

two of nuts, a first nut for securing said rod to the ground and a second nut for securing said covering to said rigid rod.

6. A shelter for storing an airplane having a fuselage wingtip and a tail, said shelter comprising:

a plurality of vertical support members arranged parallel to each other and adapted to extend over the fuselage of an airplane between the tail of the airplane and the wings of the airplane;

a cantilever beam attached to the upper portion of each one of said plurality of vertical support members, forming an upright-standing shelter structure with said cantilever beam, adapted to extend forwardly over the nose of the airplane;

a pair of lateral support members adapted to be positioned proximate to each wingtip of said airplane;

covering material arranged over said shelter structure, including over the cantilever beam and laterally to each said pair of lateral support members such that said airplane is adapted to fit entirely beneath said covering materials;

support cables attached to said cantilever beam and to each of said lateral support members for supporting said covering material over the wings of said airplane;

a hem in the edge of said covering material placed over said lateral support members and means for adjusting the tension of said covering material wherein said means for adjusting includes;

at least one anchor associated with each lateral support member;

at least one rigid member comprising an angle bracket, having a first and second plane, said angle bracket associated with each lateral support member, each rigid member having a first and second end, said first end received by said anchor;

a rod inserted into said hem, said rod having a means for receiving said second plane of said angle bracket;

a first nut for securing said rod to the ground, a second nut for securing said covering to said rod; and a third nut wherein said first nut is adapted to be secured to said first plane and said third nut is adapted to be secured to said second plane.

7. The shelter of claim 1 further including:

at least one support pole placed under said cantilever beam.

8. A shelter for storing an airplane having a fuselage, wings and a tail, said shelter comprising:

a plurality of arcuate vertical support members arranged parallel to each other, forming an apex, and adapted to extend over the fuselage of an airplane between the tail of the airplane and the wings of the airplane;

a singular cantilever beam attached to the upper portion of each one of said plurality of vertical support members at said apex, forming an upright-standing shelter structure with said cantilever beam, adapted to extend forwardly over the nose of the airplane;

a pair of lateral support members adapted to be positioned proximate to each wingtip of said airplane;

covering material arranged over said shelter structure, including over the cantilever beam and laterally to each said pair of lateral support members such that said airplane is adapted to fit entirely beneath said covering material;

support cables attached to said cantilever beam and to each of said lateral support members for supporting said covering material over the wings of said airplane;

a hem in the edge of said covering material placed over said lateral support members and means for adjusting the tension of said covering material wherein said means for adjusting includes;

at least one anchor associated with each lateral support member;

at least one rigid member associated with each lateral support member, each rigid member having a first and second end, said first end received by said anchor;

a rod inserted into said hem, said rod having a means for receiving said second end of said rigid member; and at least two nuts, a first nut for securing said rod to the ground and a second nut for securing said covering to said rod.

9. The shelter of claim 2 wherein said covering material includes a hem adapted to receive cables or rods.

10. The shelter of claim 2 further including means for adjusting the tension of said covering material.

* * * * *